US007861727B1

(12) United States Patent
Jones

(10) Patent No.: US 7,861,727 B1
(45) Date of Patent: Jan. 4, 2011

(54) CIGAR SPLITTER APPARATUS

(76) Inventor: Willie E. Jones, 2256 S. Kirkland, Chicago, IL (US) 60623

( * ) Notice: Subject to any disclaimer, the term of this patent is extended or adjusted under 35 U.S.C. 154(b) by 343 days.

(21) Appl. No.: 12/191,165

(22) Filed: Aug. 13, 2008

(51) Int. Cl.
*A24F 13/24* (2006.01)

(52) U.S. Cl. ..... 131/253; 30/111

(58) Field of Classification Search ..... 131/252–255; 30/11–113
See application file for complete search history.

(56) References Cited

U.S. PATENT DOCUMENTS

| | | | | |
|---|---|---|---|---|
| 4,001,934 | A | 1/1977 | Bell | |
| 4,106,196 | A | 8/1978 | Smithline | |
| D314,639 | S | 2/1991 | Rousseau | |
| 5,715,602 | A * | 2/1998 | Hage | 30/113 |
| 5,946,753 | A * | 9/1999 | Roberts et al. | 7/156 |
| 5,964,388 | A | 10/1999 | Jennings et al. | |
| 6,401,339 | B1 | 6/2002 | Schmidt et al. | |
| 2007/0051382 | A1 | 3/2007 | Alls | |
| 2010/0146792 | A1 * | 6/2010 | Wong | 30/113 |
| 2010/0162569 | A1 * | 7/2010 | Smith | 30/113 |

* cited by examiner

*Primary Examiner*—Carlos Lopez
(74) *Attorney, Agent, or Firm*—Crossley Patent Law; Mark A. Crossley

(57) ABSTRACT

The cigar splitter apparatus provides a smoker of cigars with a compact, precise tool for splitting a cigar along its axis. The apparatus can be selectively latched in a closed position for safety. Further, the cutter does not extend beyond the boundary of the apparatus so that use is also safe.

3 Claims, 3 Drawing Sheets

CIGAR SPLITTER APPARATUS

BACKGROUND OF THE INVENTION

Often, a split along the length of a cigar or cigarillo is wanted. For various reasons, such as the insertion of flavor enhancers, easier draw, or the like, the splits are desirable. However, few smokers have had access to a proper tool for making such splits. Often pocket knives or razors are used, an obviously dangerous practice. Further, the splits should be precisely made such that a smoke is not distorted or unnecessarily damaged. A sloppy split can easily result in an unsmokeable cigar or cigarillo. Further, the wrap on smokes is an important flavor enhancer and ascetic feature. A poorly made split or poorly made splitting tool can easily ruin the wrapper. With the cost of a good smoke often at a premium, this is an important consideration. The present apparatus provides a splitter which is precise, safe to both user and cigar, and compact.

FIELD OF THE INVENTION

The cigar splitter apparatus relates to cigar accessories and more especially to a safe and precise apparatus for splitting a cigar along the length of its axis.

SUMMARY OF THE INVENTION

The general purpose of the cigar splitter apparatus, described subsequently in greater detail, is to provide a cigar splitter apparatus which has many novel features that result in an improved cigar splitter apparatus which is not anticipated, rendered obvious, suggested, or even implied by prior art, either alone or in combination thereof.

To attain this, the cigar splitter apparatus provides a compact and safe tool for splitting a cigar. The apparatus is safe to carry in the closed position and safe to use in the open position. The clasp knobs ensure against unwanted opening of the apparatus. The cutter ensures a precise, clean split of a chosen smoke. The angle of the cutter surfaces gradually angle to a sharp point facing along the cutter orifice axis line. A user is not limited to the number of splits to be made. A user is not limited to the length of a split.

Thus has been broadly outlined the more important features of the improved cigar splitter apparatus so that the detailed description thereof that follows may be better understood and in order that the present contribution to the art may be better appreciated.

An object of the cigar splitter apparatus is to precisely split a cigar.

Another object of the cigar splitter apparatus is to split a cigar along a chosen length of its axis.

A further object of the cigar splitter apparatus is to be safe to use for both cigar and user.

An added object is of the cigar splitter apparatus is to be safe when stored.

These together with additional objects, features and advantages of the improved cigar splitter apparatus will be readily apparent to those of ordinary skill in the art upon reading the following detailed description of presently preferred, but nonetheless illustrative, embodiments of the improved cigar splitter apparatus when taken in conjunction with the accompanying drawings.

In this respect, before explaining the current embodiments of the improved cigar splitter apparatus in detail, it is to be understood that the cigar splitter apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved cigar splitter apparatus. It is therefore important that the claims be regarded as including such equivalent constructions insofar as they do not depart from the spirit and scope of the cigar splitter apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 6 thereof, the principles and concepts of the cigar splitter apparatus generally designated by the reference number 10 will be described.

Figure 1:
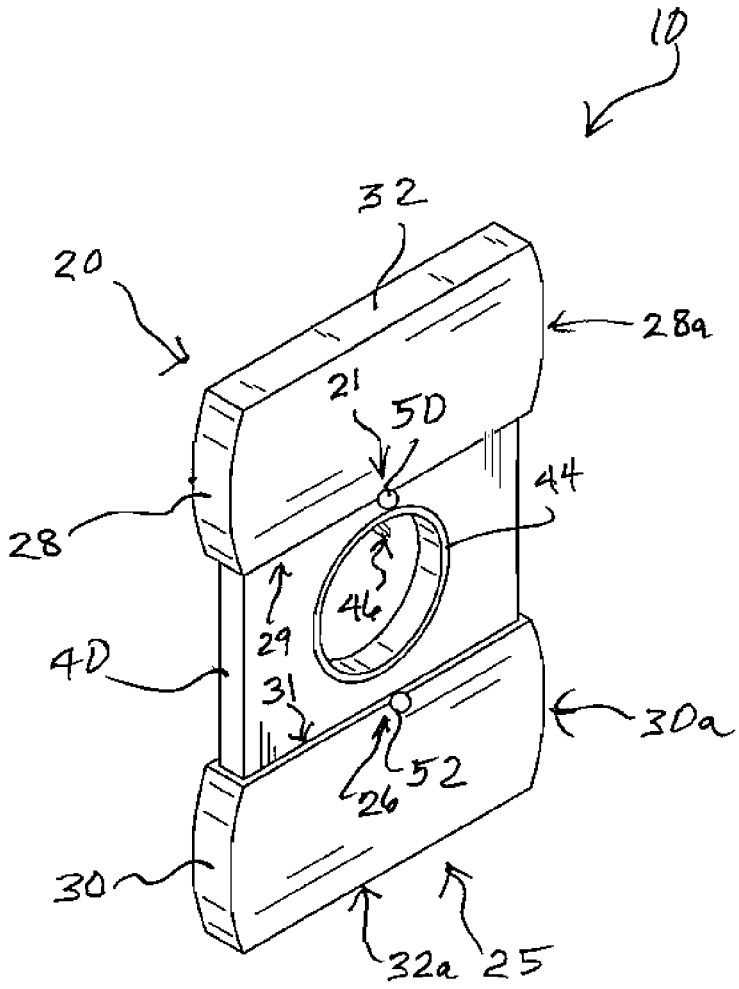
FIG. 1 is a perspective view in open position.
Figure 2:
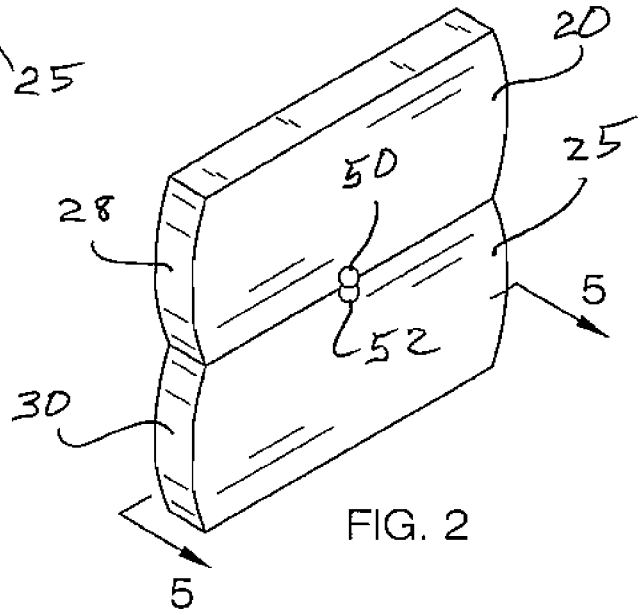
FIG. 2 is a perspective view in closed position.

Cigar Splitter Apparatus, Comprising:

Referring to FIGS. 1 and 2, the apparatus 10 partially comprises a substantially hollow first end housing 20 having a first convex side 28 spaced apart from a second convex side 28*a*. The first end housing 20 also comprises a first flat end 32 spaced apart from a first opening 29. The first end housing 20 further comprises a first center 21. The first clasp knob 50 is disposed slightly offset from the first center 21. The apparatus 10 further partially comprises a substantially hollow second end housing 25 having a third convex side 30 spaced apart from a fourth convex side 30*a*.

The second end housing 25 further comprises a second flat end 32*a* spaced apart from a second opening 31. The second clasp knob 52 is slightly offset from second center 26. The center section 40 is slideably enclosed within the first end housing 20 and second end housing 25. Sliding the first end housing 20 apart from the second end housing 25 exposes the center section 40. The second clasp knob 52 selectively frictionally engages the first clasp knob 50 with the end housings in the closed position. Slight force from a user is required to disengage the knobs to ensure that the apparatus 10 is safely carried in a closed position.

Figure 3:
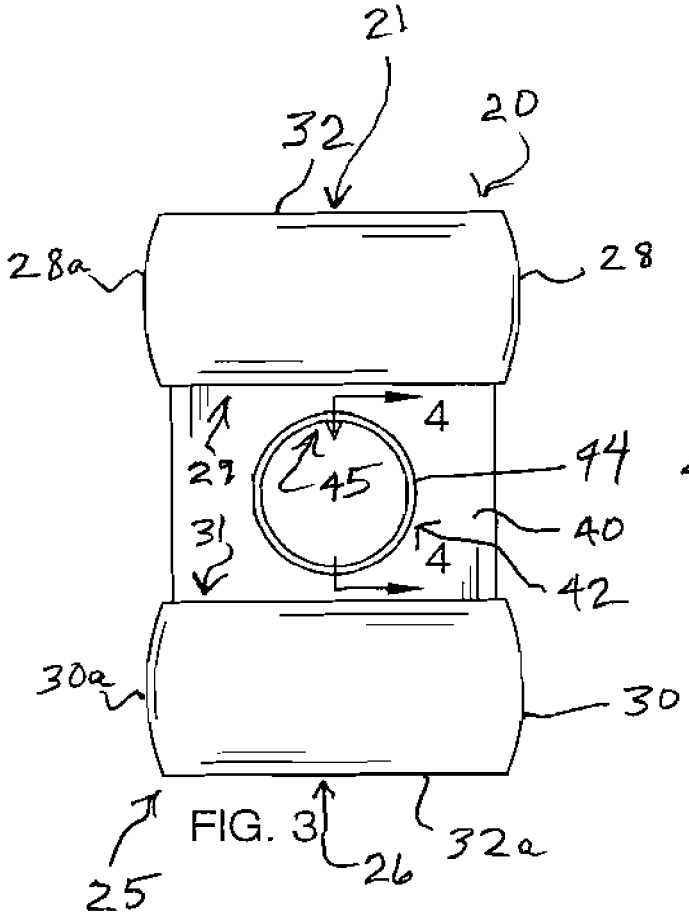
FIG. 3 is a rear elevation view in open position.

Referring to FIG. 3, note that the clasp knobs are not needed on both sides of the apparatus 10.

Figure 4:
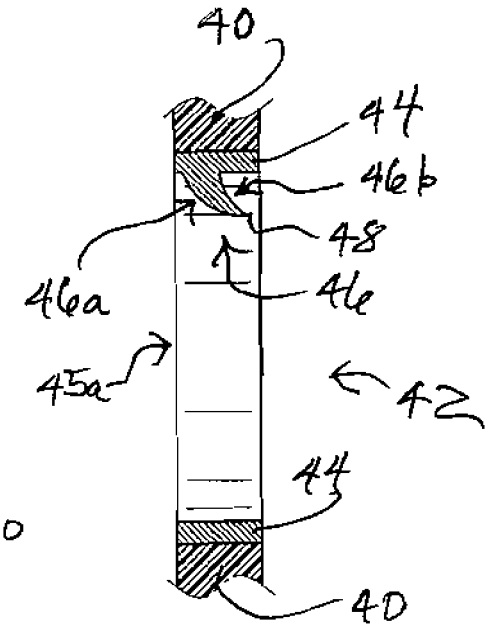
FIG. 4 is a partial cross sectional view of FIG. 3, taken along the line 4-4.

Referring to FIG. 4 and continuing to refer to FIG. 3, the center section 40 comprises the central orifice 42. The orifice ring 44 is disposed around the orifice 42. The ring 44 has a top 45 most near the first end housing 20. The cutter 46 is disposed at the top 45 of the orifice ring 44. The cutter 46 extends toward the orifice center 45*a*. The cutter 46 comprises a convex surface 46*a* spaced apart from a concave surface 46*b*. The point 48 is disposed at a meeting of the convex surface 46*a* and concave surface 46*b*. The convex surface 46*a*, concave surface 46*b* and point 48 extend along the axis of the orifice 42 and do not extend beyond the outer surface of the center section 40.

Figure 5:
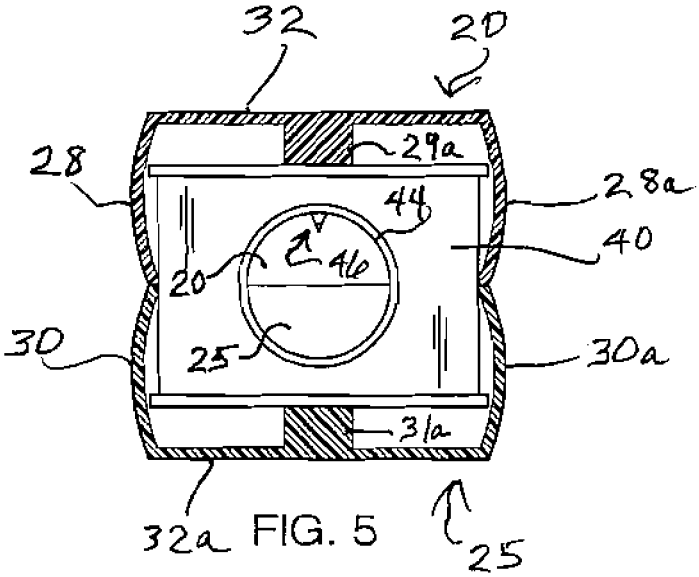
FIG. 5 is a cross sectional view of FIG. 2, taken along the line 5-5

Referring to FIG. 5, the first stop 29*a* is disposed within the first end housing 20. The first stop 29*a* extends from within the first flat end 32. The second stop 31*a* is disposed within the second end housing 25. The second stop 31*a* extends from within the second flat end 32*a*.

The stops locate the full closure of the apparatus 10, with the first end housing 20 meeting the second end housing 25 in the close position, and the first clasp knob 50 fully frictionally engaged with the second clasp knob 52.

Figure 6:
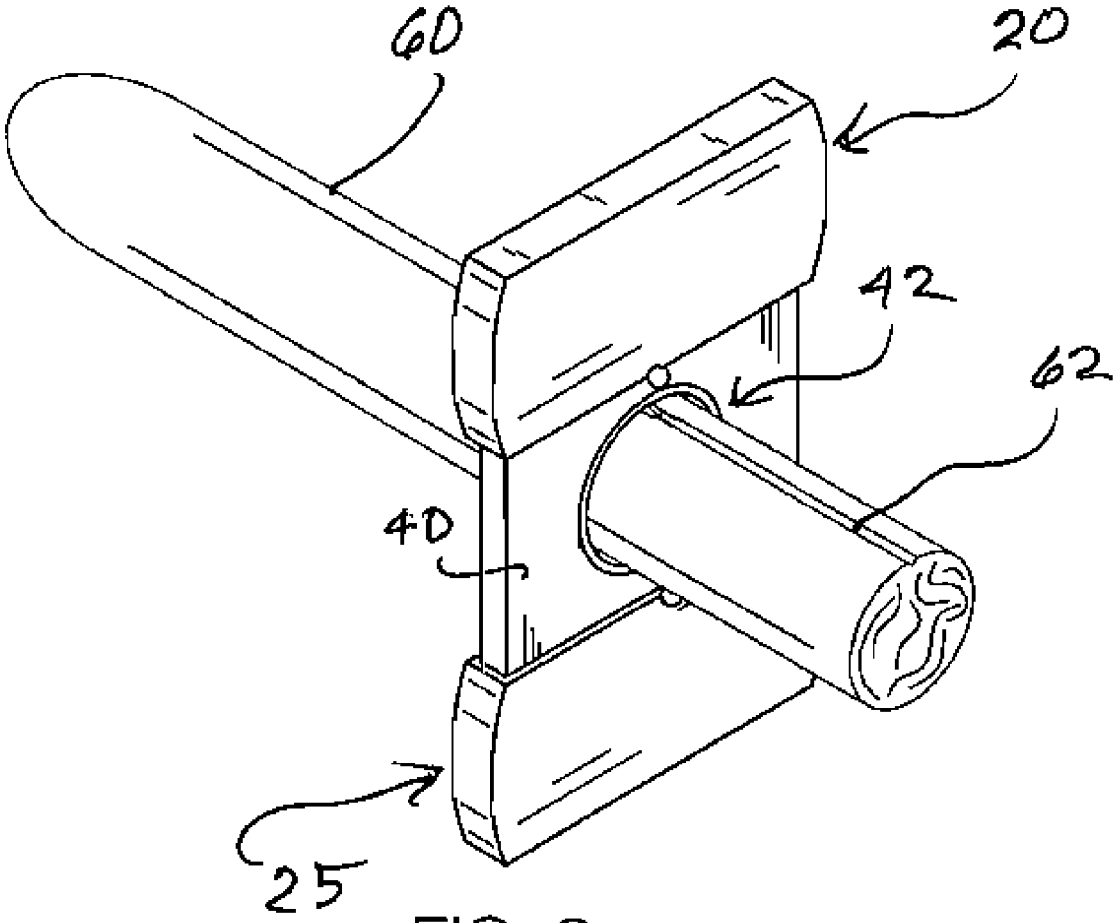
FIG. 6 is a perspective view of the apparatus in use.

Referring to FIG. 6, with the first end housing 20 fully apart from the second end housing 25, the cigar 60 is placed within the orifice 42. A user locates the cigar 60 to a desired depth, having a choice as to the length of split 62. The cigar 60 is then pulled through the orifice 42 to cut the desired split 62.

With respect to the above description then, it is to be realized that the optimum dimensional relationships for the parts of the cigar splitter apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the cigar splitter apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the cigar splitter apparatus may be used.

Therefore, the foregoing is considered as illustrative only of the principles of the cigar splitter apparatus. Further, since numerous modifications and changes will readily occur to those skilled in the art, it is not desired to limit the cigar splitter apparatus to the exact construction and operation shown and described, and accordingly, all suitable modifications and equivalents may be resorted to, falling within the scope of the cigar splitter apparatus.

What is claimed is:

1. A cigar splitter apparatus, comprising:

a substantially hollow first end housing having a first convex side spaced apart from a second convex side, a first flat end spaced apart from a first opening, and a first center;

a substantially hollow second end housing having a third convex side spaced apart from a fourth convex side, a second flat end spaced apart from a second opening, and a second center;

means for selectively attaching the first end housing to the second end housing when in a closed position;

a center section slideably enclosed within the first end housing and the second end housing, the center section exposed with the first end housing and the second end housing in an open position, the center section comprising:

a centrally disposed orifice having an orifice center;

an orifice ring disposed around the orifice, the ring having a top disposed most near the first end housing;

a cutter disposed at the top of the orifice ring, the cutter extended toward a center of the orifice, the cutter comprising:

a convex surface spaced apart from a concave surface;

a point at a meeting of the convex surface and the concave surface, the convex surface, the concave surface and the point extended along an axis of the orifice.

2. A cigar splitter apparatus, comprising:

a substantially hollow first end housing having a first convex side spaced apart from a second convex side, a first flat end spaced apart from a first opening, and a first center;

a first clasp knob disposed proximal to the first opening, the first clasp knob slightly offset from the first center;

a substantially hollow second end housing having a third convex side spaced apart from a fourth convex side, a second flat end spaced apart from a second opening, and a second center;

a second clasp knob disposed proximal to the second opening, the second clasp knob slightly offset from the second center, the second clasp knob selectively frictionally engaged with the first clasp knob with the first end housing and the second end housing in a closed position;

a center section slideably enclosed within the first end housing and second end housing, the center section exposed with the first end housing separated from the second end housing in an open position, the center section comprising:

a centrally disposed orifice having an orifice center;

an orifice ring disposed around the orifice, the ring having a top disposed most near the first end housing;

a cutter disposed at the top of the orifice ring, the cutter extended toward a center of the orifice, the cutter comprising:

a convex surface spaced apart from a concave surface;

a point at a meeting of the convex surface and the concave surface, the convex surface, the concave surface and the point extended along an axis of the orifice.

3. A cigar splitter apparatus, comprising:

a substantially hollow first end housing having a first convex side spaced apart from a second convex side, a first flat end spaced apart from a first opening, and a first center;

a first stop disposed within the first end housing, the first stop extended from within the first flat end;

a first clasp knob disposed proximal to the first opening, the first clasp knob slightly offset from the first center;

a substantially hollow second end housing having a third convex side spaced apart from a fourth convex side, a second flat end spaced apart from a second opening, and a second center;

a second stop disposed within the second end housing, the second stop extended from within the second flat end;

a second clasp knob disposed proximal to the second opening, the second clasp knob slightly offset from the second center, the second clasp knob selectively frictionally engaged with the first clasp knob with the first end housing and the second end housing in a closed position;

a center section slideably enclosed within the first end housing and the second end housing, the center section exposed with the first end housing and the second end housing in an open position, the center section comprising:

a centrally disposed orifice having an orifice center;

an orifice ring disposed around the orifice, the ring having a top disposed most near the first end housing;

a cutter disposed at the top of the orifice ring, the cutter extended toward a center of the orifice, the cutter comprising:

a convex surface spaced apart from a concave surface;

a point at a meeting of the convex surface and the concave surface, the convex surface, the concave surface and the point extended along an axis of the orifice.

* * * * *